United States Patent [19]

Sorenson

[11] 3,933,221

[45] Jan. 20, 1976

[54] LADDER ADJUSTING AND STABILIZING APPARATUS

[76] Inventor: Virgil H. Sorenson, P.O. Box 198, Staffordville, Conn. 06077

[22] Filed: May 3, 1973

[21] Appl. No.: 357,070

Related U.S. Application Data

[63] Continuation-in-part of Ser. No. 209,073, Dec. 17, 1971, abandoned.

[52] U.S. Cl. ..... 182/172

[51] Int. Cl.[2] ..... E06C 1/04; E06C 1/22

[58] Field of Search ..... 182/172, 201, 204, 205, 182/107, 108, 111

[56] References Cited

UNITED STATES PATENTS

| | | | |
|---|---|---|---|
| 1,862,171 | 6/1932 | Baker | 182/205 |
| 2,354,904 | 8/1944 | Young | 182/108 |
| 3,025,926 | 3/1962 | Vives | 182/201 |
| 3,059,723 | 10/1962 | Shore | 182/107 |
| 3,508,628 | 4/1970 | Conrad | 182/172 |
| 3,618,703 | 11/1971 | Wilke | 182/107 |

FOREIGN PATENTS OR APPLICATIONS

| | | | |
|---|---|---|---|
| 950,754 | 10/1956 | Germany | 182/172 |
| 990,381 | 6/1951 | France | 182/172 |

*Primary Examiner*—Reinaldo P. Machado

[57] ABSTRACT

Lateral stabilizing supports for a ladder which are secured to the ladder by a pair of horizontal braces which extend through hollow rungs for added strength and means for modifying the length of one of the legs of the ladder as well as the supports to compensate for irregularities in the surface upon which the ladder is standing. A simple, quick acting locking arrangement is provided for locking the adjustable legs in their operative positions.

10 Claims, 8 Drawing Figures

Figure 1:
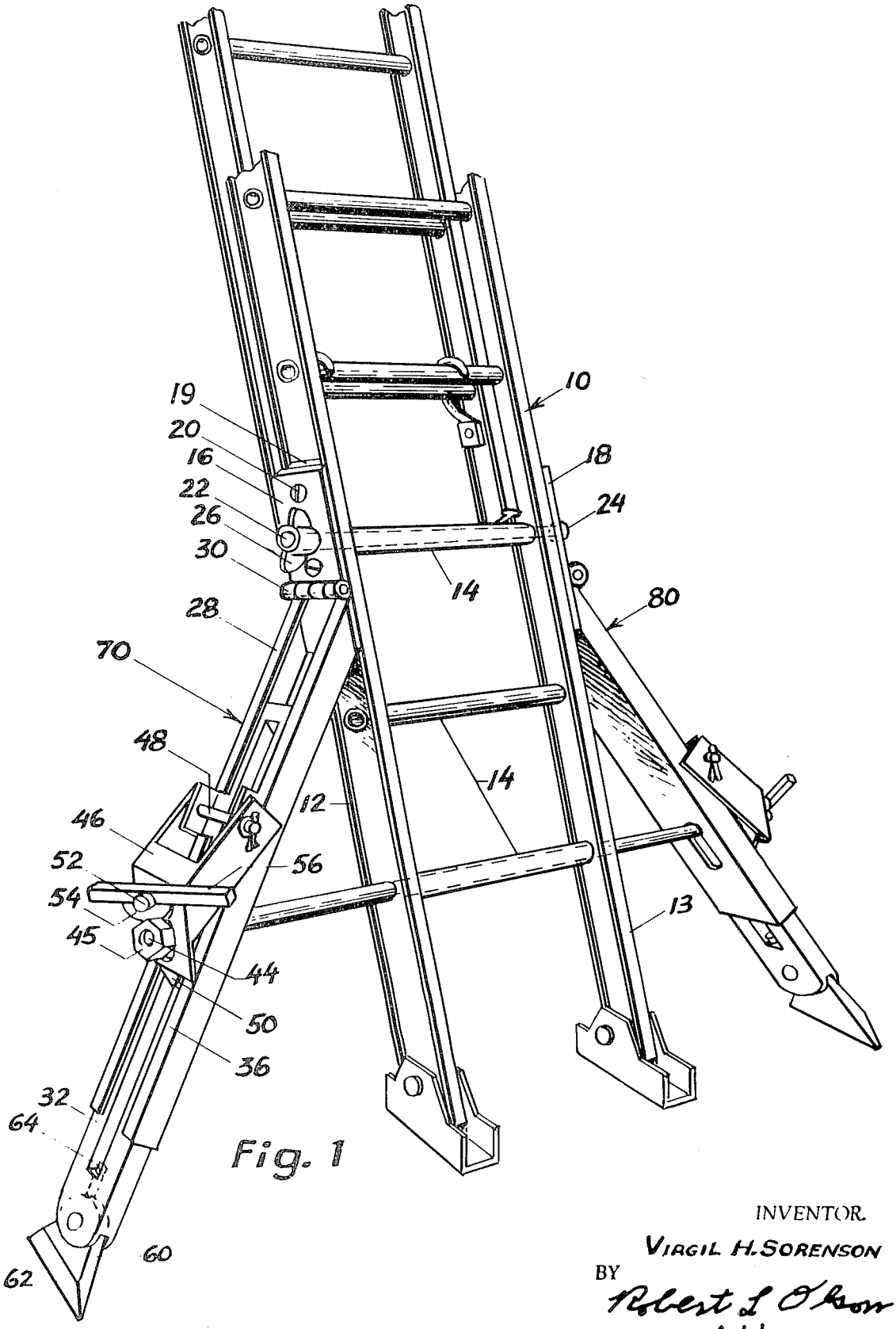

INVENTOR.
VIRGIL H. SORENSON
BY
Robert L Olson
Attorney

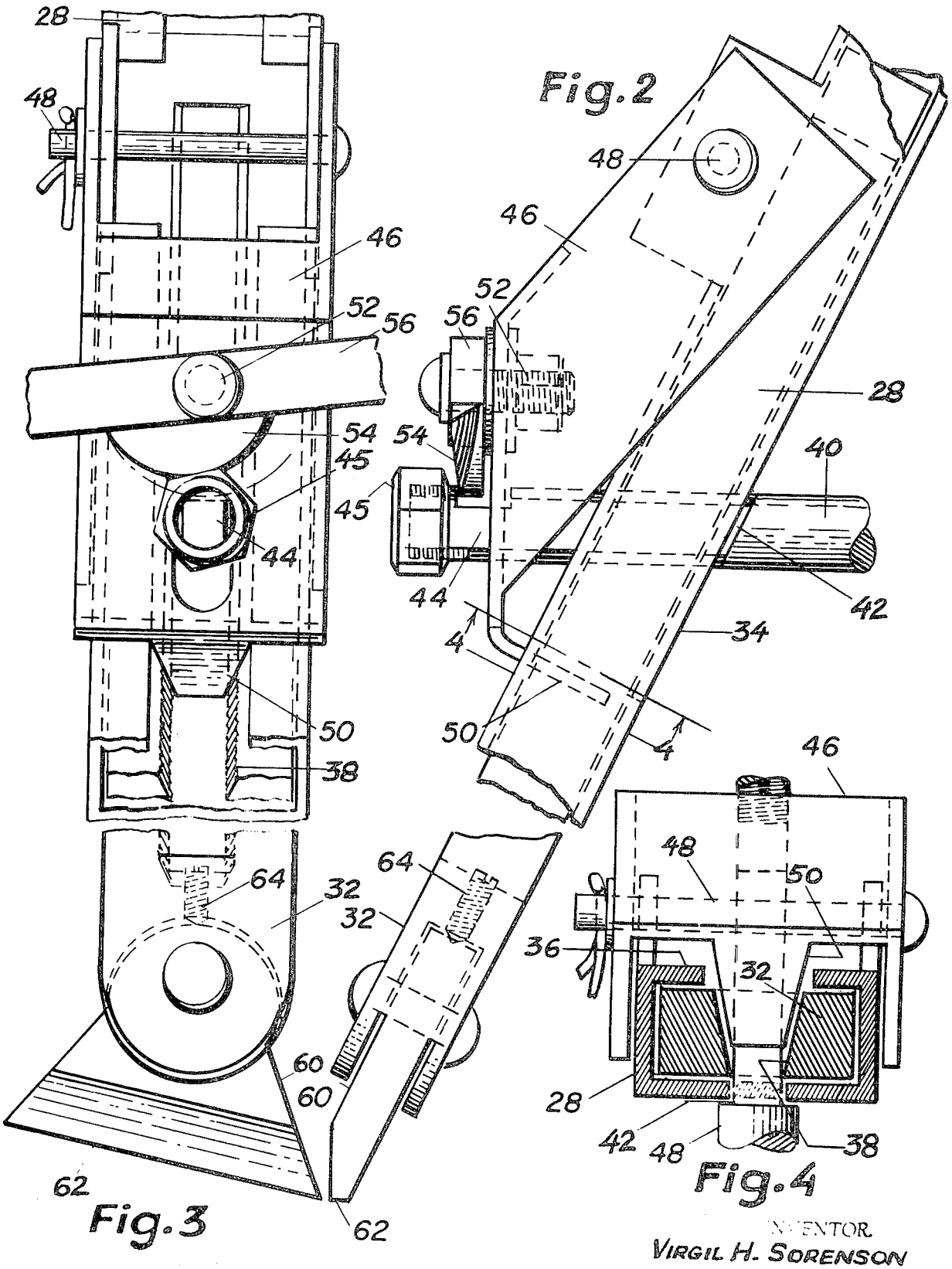
INVENTOR
VIRGIL H. SORENSON
BY
Robert L Olson
Attorney

LADDER ADJUSTING AND STABILIZING APPARATUS

This is a Continuation-In-Part application of application Ser. No. 209,073 filed Dec. 17, 1971 entitled Ladder Stabilizer.

This invention relates to stabilizing apparatus for extension ladders and more specifically to novel and improved means for bracing extension ladders to prevent lateral movement and at the same time providing means for effectively extending the length of one leg of the ladder to compensate for ground slope.

In using ladders, particularly extension ladders for reaching high places, it is desirable to support the ladder to keep it from sliding to one side or the other. While lateral supports have been suggested for stabilizing ladders, known structures are either expensive, too cumbersome for one person to easily handle and manipulate, or are not sufficiently rigid to provide adequate support particularly for tall ladders.

The ladder supports in accordance with the invention are in the form of laterally extending legs secured to the side rails of a ladder at their upper ends and extending downwardly at an angle to contact the ground. A pair of horizontal brace members extend through hollow rungs of the ladder for strength and stability. The legs are adjustable in length and have a locking arrangement which permits quick, easy and positive locking of the support arrangement in its operative position. The legs of the ladder are also adjustable in length.

Figure 5:
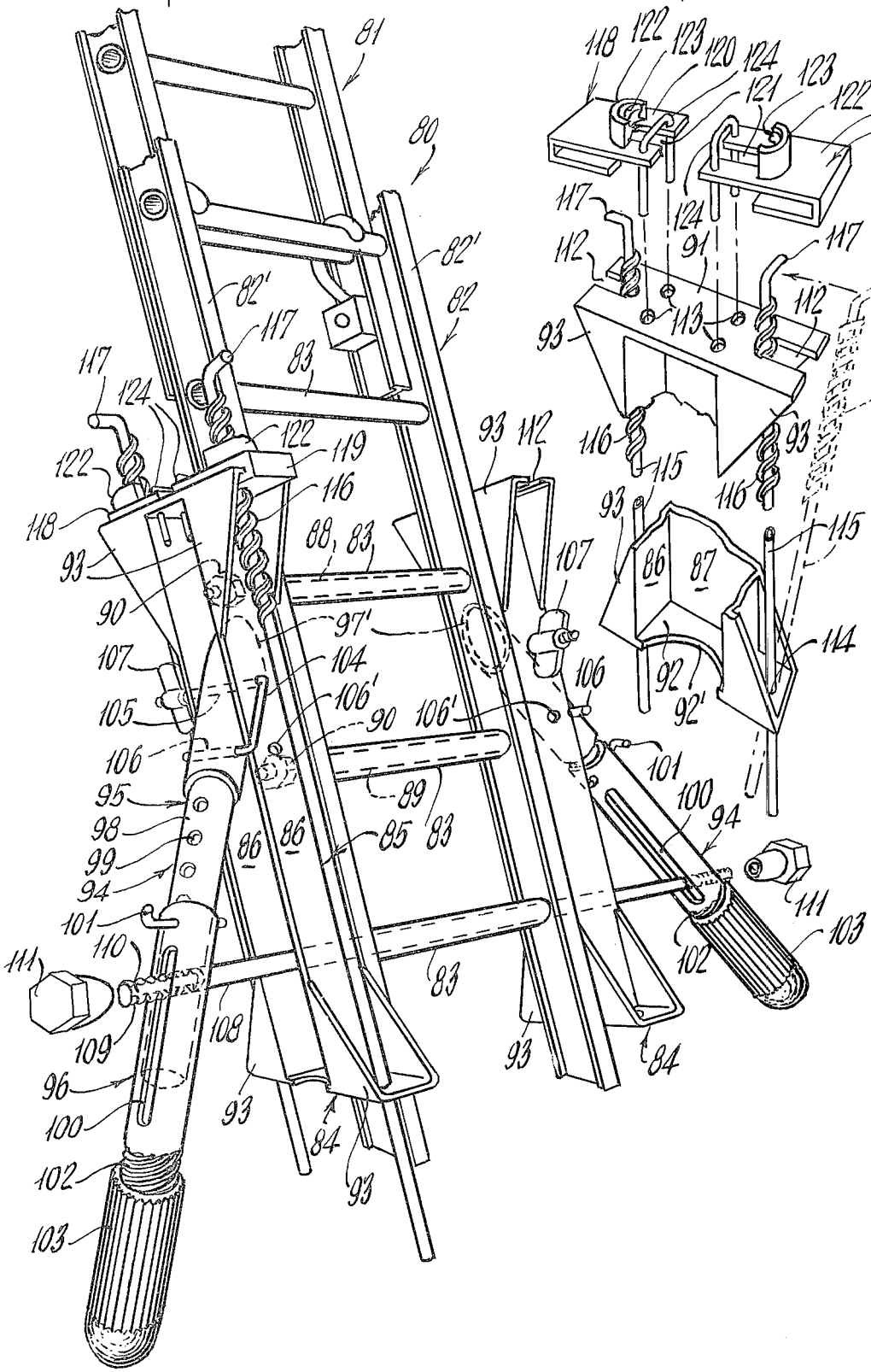
Figure 6:
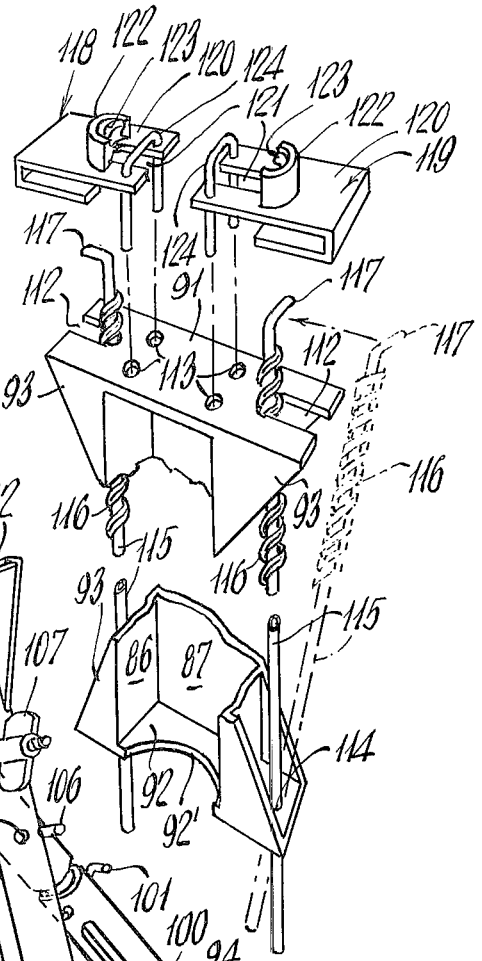
Figure 7:
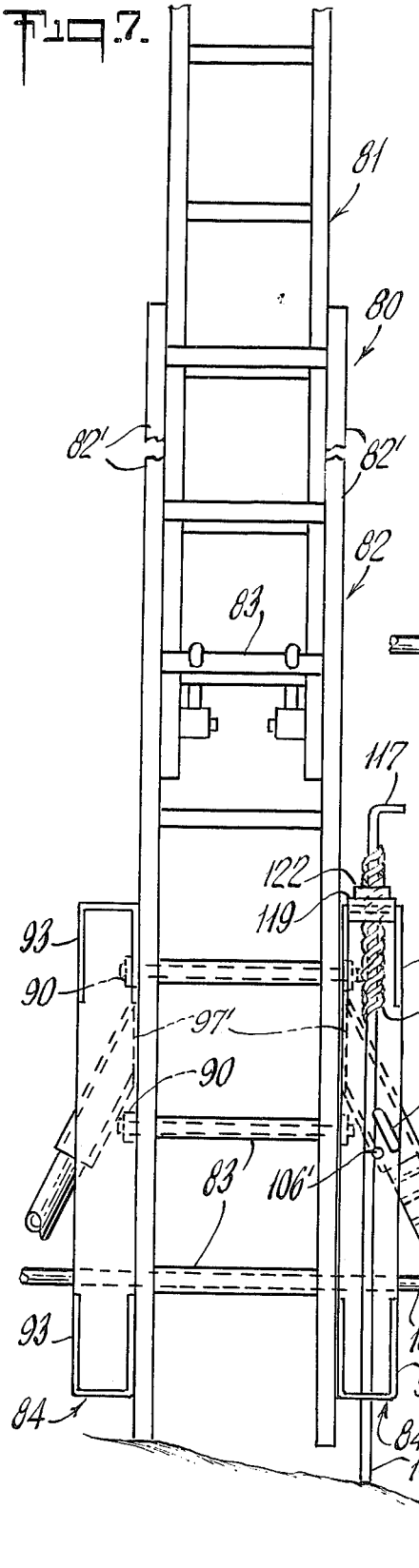
Figure 8:
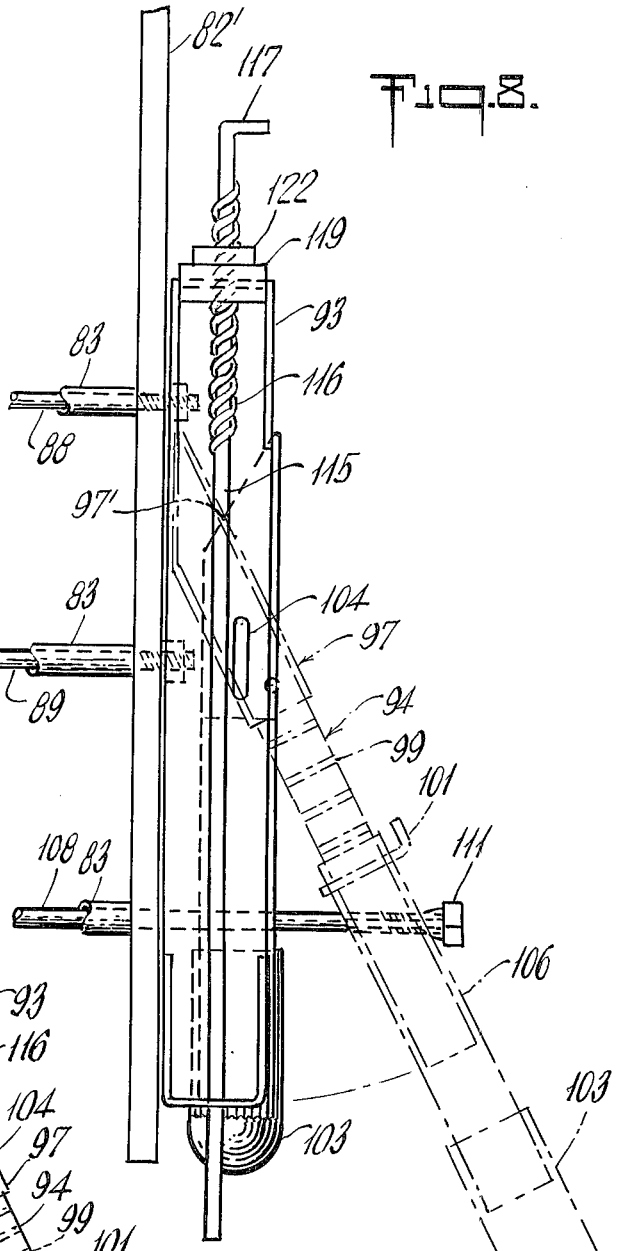

In the Drawings:

FIG. 1 is a perspective view of a ladder with one embodiment of stabilizing supports in accordance with the invention, FIG. 2 is an enlarged front view of one support of FIG. 1 showing the adjustable locking means, FIG. 3 is a side view of the structure shown in FIG. 2, FIG. 4 is a cross-sectional view of FIG. 2 on line 4—4 thereof, FIG. 5 is a perspective view of a modified embodiment of ladder stabilizing means in accordance with the invention, FIG. 6 is an exploded perspective view of the stabilizer attaching means of FIG. 5 which includes means for adjusting the length of a ladder leg to compensate for ground slope, FIG. 7 is a front elevational view of the ladder and stabilizers of FIG. 1 and shows the structure for compensating for ground slope, and FIG. 8 is a fragmentary side elevational view showing a stabilizer in the stored position when not in use.

Referring now to the drawings and more specifically to FIG. 1, numeral 10 denotes a ladder having side rails 12,13, with a plurality of spaced hollow rungs 14 secured therebetween. The ladder stabilizer of the present invention has a pair of upper plates 16 and 18 which lie flat against the outer surfaces of the ladder rails 12 and 13. An inner plate member 19 is secured by screws or bolts 20 to outer plate 16, and snugly fits the channel in rail 12. The two plates 16 and 18 are held in place by means of a long bolt 22, which extends through one of the hollow rungs 14. The bolt 22 has a head 24 on one end thereof, and is threaded at the other end with the wing nut 26.

A leg 70 is pivotally secured to plate 16 by means of hinge 30 and includes an upper portion 28. Nested within and slidable longitudinally of the upper leg portion 28 is a lower leg member 32. As seen in FIG. 3, both side walls 34 and 36 of upper leg 28, and also lower leg 32, have longitudinal slots therein. The edges 38 of the slot in lower leg member 32 are serrated and tapered (FIG. 4) to receive a locking member 50.

Referring again to FIGS. 1 and 2, a rod 40 extends through a second lower hollow rung 14 of the ladder. The ends 44 of the rod 40 are of reduced rectangular section with the shoulders between the reduced sections and the remainder of the rod being inclined at the angle at which the leg portions of both stabilizers are positioned so that they lie flat against the surface of side wall 34 of each upper leg 28. The rod 40 is larger than the slots in walls 34 so that the shoulders rest solidly thereagainst. A slot is located in the upper surface of each bar end 44 for coacting with cams 54. The nuts 45 are threaded onto the ends 44 of bar 40 for adjustable coacting with the cam as will be explained.

Locking member 46 is pivotally secured to upper leg member 28 by means of pivot pin 48 and includes a wedge 50 integral therewith. The cam member 54 is pivotally attached to the locking member 45 by means of the pivot pin 52. Handle member 56 formed integrally with cam 54 facilitates rotation of the cam. The end of lower leg member 32 has a foot 60 which is pivotally attached thereto so that it can be adjusted to have the lower edge 62 firmly in contact with the ground when the ladder stabilizer is in its operative position, regardless of ground irregularities or the angle at which the ladder is leaning against the side of a building. A locking or set screw 64 is used for locking the foot 60 in its desired position.

Although only one leg 70 of the ladder stabilizer has been described, the other leg 80 (FIG.1) is constructed identically. The method of placing the ladder stabilizer in its operative position will now be described. Leg member 70 is pivoted downwardly from an upper storage position to the position shown in FIG. 1. Rod 40 is inserted through rung 14 so that the ends 44 of bar 40 extend through the slots in the upper and lower leg portions 28 and 32 of the stabilizers. The lower leg portion of each stabilizer is then moved downwardly into firm contact with the ground and foot 60 is locked in place by set screw 64. Locking member 46 of each stabilizer which up to this point had been in its inoperative position above pivot pin 48, is pivoted downwardly so that the wedge 50 contacts the serrated edges of slot 38 in lower leg 32 forcing it into contact with side wall 34 of the upper leg portion 28. It should be noted that the slot in wall 36 is large enough so wedge 50 passes through it. Side wall 34 is likewise forced into engagement with the end 42 of rod 40. Cam 54 is then manually pivoted counterclockwise so that the cam surface coacts with the edge of the slot in the bar end 44. This locks the leg portions 28 and 32 tightly together and also locks both leg portions tightly against the end 42 of rod 40. After long use, because of wear, the cam 54 may not force the wedge 50 in as tightly as desired. When this happens, nut 45 can be rotated to the right (FIG. 2) until it extends slightly into the slotted area. The cam 50 will then coact with the inner surface of the nut 45 to tighten the wedge 50. The same operation is repeated on the other side of the ladder. The upper end of each upper leg portion 28 has a surface which lies flat against the outer surface of side rail 12. This adds to the rigidity of the stabilizer and also determines the angle at which the lateral leg 70 extends from the ladder side rail 12. An angle of approximately 30° is desirable.

A modified embodiment of the invention is shown in FIGS. 5 through 7 which not only includes lateral stabilizers but also means for lengthening the leg or lower end of one of the ladder rails to compensate for ground slope to support the stabilizers when not in use. More specifically, the ladder generally denoted by the numeral 80, includes upper and lower sections 81 and 82 with at least the lower section 82 having hollow rungs 83. While the invention will be described in connection with a metal ladder having hollow rungs, it will become apparent that it is also useful with wood ladders by replacing two or more of the rungs with tubing of appropriate strength to receive transverse rods as will be described.

The stabilizer supports are denoted by the numeral 84 and each comprises an elongated channel portion 85 having outwardly extending legs 86 and a transverse member 87 which lies flat against the associated ladder rail 82'. The supports are secured to the ladder rails 82' by a pair of bolts 88 and 89 extending through two rungs 83 and secured in position by nuts 90. The upper and lower ends of the channels 85 carry transverse members 91 and 92 which may be formed integrally therewith and braced by triangular corner braces 93.

The stabilizers denoted by the numerals 94 each include upper and lower telescoping portions 95 and 96 with the upper member consisting of a sleeve portion 97 fixedly secured to a tubular portion 98 having a plurality of spaced holes 99 and a lower elongated slot aligned with the slot 100 in the lower portion 96. The lower portion 96 slidably receives the tubular member 98 and has aligned diametral openings to receive a pin 101. In this way the length of the stabilizer can be adjusted by engaging the pin 101 with the desired hole 99 in the tubular member. The bottom of each stabilizer includes a threaded portion 102 and a threaded cap 103 to precisely adjust the total length of the stabilizer.

The sleeve portion 97 of the stabilizer has an inclined end 97' which fits flush against the transverse portion 87 of the channel member when the stabilizer is in use as shown in FIG. 5. Each stabilizer is secured in position by a U-shaped member 104 having a threaded leg 105 extending through cooperating openings in the channel legs 86 and the stabilizer sleeve 97 and secured in position by a wing nut 107. The other leg 106 also extends through a cooperating opening in sleeve 97. The lower ends of the stabilizers 94 are held in position by the rod 108 which extends through the lowermost rung 83. The ends of the rod 108 each has a threaded portion 110, the latter forming a shoulder at the inner termination of each threaded portion to bear against the edges of the slot 100. Nuts 111 engage the threaded ends of rod 108 to securely fix the stabilizers in the inclined position.

When the stabilizers 94 are not in use the rod 108 is removed and the wing nut 107 on one leg of the U-bolt 104 is removed. The U-bolt 104 is then withdrawn and the stabilizer is shortened by removal of the pin 101 and reinserting it in the uppermost opening 99. The stabilizer is then placed within the channel 85 and the U-bolt 104 is again inserted but with the lower leg 106 engaging the opening 106' in the channel leg 86. This arrangement will secure the stabilizers within their respective channels as shown more clearly in FIG. 8. The bottom plate 92 of each stabilizer support is recessed as shown at 92' to receive the lower end of the stabilizer.

The upper plate 91 of each stabilizer support has a pair of slots extending inwardly from each edge and a pair of openings 13 spaced inwardly from the inner edge of each slot. The bottom plate 92 has a pair of openings 114 vertically aligned with the roots of the recesses 112 to slidably receive rods 115, the upper ends of which have threaded portions 116. The tops of the rods are preferably bent to form handle-like elements 117.

The rods 115 are held in position of each stabilizer support by a pair of U-shaped brackets 118 and 119. Each bracket has a width slightly less than the distance between the triangular supports 93 for the plate 91 and the top leg 120 of each support has a recess 121 extending inwardly from the end thereof. A semicircular collar 122 having internal threads 123 is secured to each top leg and aligned with the root of the recesses 121. the ends of the legs 120 also include a pair of openings to receive U-bolts 124.

With this arrangement the rods 115 after being inserted through the openings 114 are moved inwardly so that the threaded portions 116 engage the recesses 112. The brackets 118 and 119 are then inserted over the ends of the plate 91 until the collars 123 engage the threaded end portions 116 of the rods. The U-bolts 124 are then dropped in place and engage the openings in the leg 120 of each bracket and the cooperating openings in the plate 91. This locks the U-shaped members 118 and 119 in position and the rods 115 can be adjusted vertically by rotation thereof to compensate for ground contour. With this arrangement it is quite evident that the rods 115 can be quickly and easily installed in either stabilizer support depending on ground slope.

While only certain embodiments of the invention have been illustrated and described, it is apparent that alternations, modifications and changes may be made without departing from the true scope and spirit thereof as defined by the appended claims:

What is claimed is:

1. Stabilizing means for a ladder having side rails with interconnecting rungs and including at least two spaced tubular rungs comprising a first elongated rod extending through one of said rungs, a second elongated rod extending through the other of said rungs, a pair of stabilizers positioned on each side of said ladder, and means on said stabilizers fixedly securing them to said rods and relative to said ladder with the stabilizers extending downwardly and outwardly to engage a surface upon which the ladder rests, the last said means comprising a pair of elongated stabilizer supports secured by at least one of said rods to opposite sides of said ladder and means securing the upper ends of said stabilizers to said supports, said supports being disposed in parallel relationship to said ladder rails and at least one longitudinally adjustable element is removably carried by one of said supports and extendable below the bottom of the adjoining rail to compensate for ground slope, each support comprising an elongated channel shaped member having a pair of legs and a transverse member coupling said legs, said transverse member lying against one of said ladder rails, transverse members secured to the upper and lower ends of said channel members and having upper and lower aligned openings for removably receiving longitudinally adjustable elements.

2. Stabilizing means according to claim 1 wherein the openings in said upper transverse member are in the form of slots extending inwardly from each end of said transverse member, said longitudinally adjustable elements are in the form of rods having threaded portions on the upper ends thereof for slidable engagement with said slots and means releasably closing said slots and engaging the threaded ends of said rods whereby rotation of said rods will move said rods longitudinally.

3. Stabilizing means for a ladder having side rails with interconnecting rungs and including at least two spaced tubular rungs, a second elongated rod extending through the other of said rungs, a pair of stabilizers positioned on each side of said ladder, and means on said stabilizers fixedly securing them to said rods and relative to said ladder with the stabilizers extending downwardly and outwardly to engage a surface upon which the ladder rests, the last said means comprising a pair of elongated stabilizer supports secured by at least one of said rods to opposite sides of said ladder and means securing the upper ends of said stabilizers to said supports, the upper ends of said stabilizers being pivotally secured to said supports and have longitudinally disposed slots engaging the other of said rods.

4. Stabilizing means according to claim 3 wherein said stabilizers are longitudinally adjustable.

5. Stabilizing means according to claim 4 wherein each stabilizer includes two telescoping portions adjustable one relative to the other and the lower end of each stabilizer includes a longitudinally adjustable foot.

6. Stabilizing means for a ladder having side rails with interconnecting rungs and including at least two spaced tubular rungs comprising a first elongated rod extending through one of said rungs, a second elongated rod extending through the other of said rungs, a pair of stabilizers positioned on each side of said ladder, and means on said stabilizers fixedly securing them to said rods and relative to said ladder with the stabilizers extending downwardly and outwardly to engage a surface upon which the ladder rests, each stabilizer including first plate means engageable with the outer surface of one of the ladder side rails, a second plate means engageable with the outer surface of the other side rail, one elongated rod extending through both plate means and one of the hollow rungs of the ladder, nut means engaging said rod for securely fastening the first and second plate means, respectively, at their upper ends, said first and second stabilizers each having an upper ends, said first and second stabilizers each having an upper leg portion and a lower leg portion, with sections thereof being coextensive, the lower leg portions being slidable within the upper leg portions, the upper and lower leg portions of each of the stabilizers having aligned longitudinal slots therein, said other rod extending through a second rung of the ladder with the ends of the rod abutting the inner surface of the upper leg portions, said other rod being of such a length so as to position the first and second stabilizers such that each forms an acute angle with its respective side rail, the ends of the rod means extending at an angle such that they have surfaces which are parallel with the inner surface of the upper leg portions, each of the ends of the other rod having attached thereto extensions of reduced cross section, which extensions extend through the slots in the upper and lower leg portions, wedge means for forcing each lower leg portion into tight engagement with its upper leg portion and also the associated end of the other rod, and locking means coacting with the extensions for tightly holding the wedge means in position.

7. Stabilizing means according to claim 6 wherein each wedge means is integral with a member pivotally secured to the upper leg portion, and the wedge means extends into the slot in the lower leg portion when in its locked position.

8. Stabilizing means according to claim 7 wherein the edges of the slots in the lower leg portions are tapered and serrated.

9. Stabilizing means according to claim 8 wherein each locking means is a cam member pivotally secured to the member which is pivotally secured to the upper leg portion, nut means adjustably secured to the extension, the cam member coacting with the nut means to tightly force the lower and upper leg portions into engagement with the end of the rod means.

10. Ladder adjusting means comprising elongated members secured to and in alignment with the side rails of a ladder, transverse plates disposed at the upper and lower ends of each elongated member and a longitudinally adjustable element extending through the openings on at least one side of said ladder, each upper and lower plate including two openings with said upper openings being in the form of slots extending inwardly from edges of said upper plates for engaging two lingitudianl adjustable elements, and said longitudinally adjustable elements are in the form of rods having threaded portions on the upper ends thereof for slidable engagement with said slots and means releasably closing said slots and engaging the threaded ends of said rods whereby rotation of said rods will move said rods longitudinally.

* * * * *